United States Patent [19]

Kose et al.

[11] 4,054,164

[45] Oct. 18, 1977

[54] PENCIL SHARPENER

[75] Inventors: Ryoji Kose, Shimodate; Syoichi Saito, Funabashi; Masahito Ogiwara, Kamagaya, all of Japan

[73] Assignee: Hitachi Chemical Co., Ltd., Tokyo, Japan

[21] Appl. No.: 732,199

[22] Filed: Oct. 14, 1976

[30] Foreign Application Priority Data

Oct. 17, 1975 Japan ..... 50-141590

[51] Int. Cl.[2] ..... B43L 23/00

[52] U.S. Cl. ..... 144/28.7; 144/28.1

[58] Field of Search ..... 145/3.1, 3.2, 3.31, 145/3.32, 3.5, 3.6; 144/28.1, 28.6, 28.7, 28.72, 28.8

[56] References Cited

U.S. PATENT DOCUMENTS 3,991,798 11/1976 Grosjean ..... 144/28.1

FOREIGN PATENT DOCUMENTS 2,225,069 7/1972 Germany ..... 144/28.7

*Primary Examiner*—Othell M. Simpson
*Assistant Examiner*—W. D. Bray
*Attorney, Agent, or Firm*—Birch, Stewart, Kolasch and Birch

[57] ABSTRACT

A pencil sharpener of a rotary type including a rotary blade having spiral cutting edges and a blade holder, wherein the rotary blades makes a rotation around its own axis while making a revolution around a rotational axis of the assembly of the rotary blade and the blade holder by a cooperation of a pinion carried by the rotary blade and a fixed annular internal gear, wherein a cover means is provided to isolate the meshing region of the pinion and the annular internal gear from the shaving region effected by the spiral cutting edges.

4 Claims, 5 Drawing Figures

PENCIL SHARPENER

BACKGROUND OF THE INVENTION

1. Field of the Invention

The present invention relates to a pencil sharpener and, more particularly, a rotary type pencil sharpener improved with respect to the treatment of the shavings.

2. Description of the Prior Art

A rotary type pencil sharpener comprising a frame, a rotary blade having spiral cutting edges and a pinion, a blade holder which rotatably supports said rotary blade and defines a conical cavity for receiving an end of a pencil therein, said blade holder being supported by said frame to be rotatable around the axis of said conical cavity, an annular internal gear fixedly supported by said frame and meshing with said pinion, and a drive shaft which drives said blade holder around said axis, is not new. In this conventional pencil sharpener, no means are provided to prevent the pencil shavings from entering into the meshing region of said pinion and internal gear and, therefore, there is a problem that if the pencil sharpener is used in a manner such that the pencil shavings drop into the gear meshing region, they are bitten by the meshing gear teeth thereby causing a lock-stopping of the pencil sharpener. Because of this reason, the conventional pencil sharpener of this type is generally used in a horizontal position such that the blade holder is rotated around a horizontal axis.

However, it is desirable that the pencil sharpener is capable to operate in any position, particularly when the pencil sharpener is formed as a portable one.

SUMMARY OF THE INVENTION

Therefore, it is the object of the present invention to provide a pencil sharpener of the afore-mentioned rotary type which is capable to operate in any position without causing a biting-in of the pencil shavings in the meshing region of the pinion and the annular internal gear.

According to the present invention, the above-mentioned object is accomplished by a pencil sharpener comprising a frame, rotary blade including a cylindrical portion having spiral cutting edges and a pinion co-axially provided at one end of said cylindrical portion, a blade holder which rotatably supports said rotary blade and defines a conical cavity for receiving an end of a pencil therin, said blade holder being supported by said frame to be rotatable around the axis of said conical cavity, an annular internal gear fixedly supported by said frame and meshing with said pinion, a drive shaft which drives said blade holder around said axis, and a cover means supported by said blade holder to be rotatable therewith, said cover means traversing said blade holder and said rotary blade thereby isolating the meshing region of said pinion and said annular internal gear from said conical cavity.

The cover means may preferably be a cup-shaped member having a cylindrical side wall and a oblique end wall, wherein said side wall engages over said annular internal gear with a small clearance left therebetween, while said end wall has first and second openings, said first opening fixedly receiving a part of said blade holder, whereas said second opening rotatably receives said rotary blade at a portion between said spiral cutting edge and said pinion. The cover means of this structure may conveniently be made of two halves which are joined together along a joint which passes the centers of the said first and second openings. By this arrangement, the cover means is readily mounted to its operating position which traverses said blade holder and said rotary blade in a manner such that it isolates the meshing region of said pinion and said annular internal gear from said conical cavity. The joint of said two halves may incorporate a rib and a groove adapted to engage with each other to provide a firm assembly of the two halves or the cup-shaped cover means.

Other objects and further scope of applicability of the present invention wil become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

The present invention will now be described in more detail with reference to the accompanying drawing.

Figure 1:
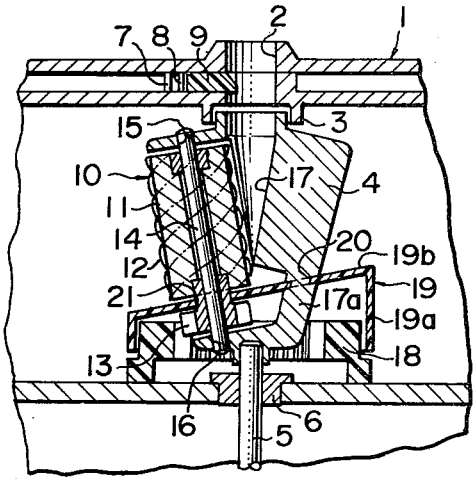
FIG. 1 is a sectional view of an essential portion of a pencil sharpener according to the present invention; and FIGS. *2a, 2b* and *3a, 3b* are the views showing the two halves which provide the cover means incorporated in the structure shown in FIG. 1.

In FIG. 1, 1 designates a part of the frame for housing the pencil sharpener formed with an opening 2 through which a pencil (now shown) is inserted to be sharpened by the sharpening mechanism as described hereinbelow. Around the opening 2 the frame is formed with an internal bearings flange 3, in which is rotatably received an end of a blade holder 4, the other end of the holder is supported by a drive shaft 5, which is rotatably supported by a bearing means 6 mounted in the frame 1. The drive shaft 5 is adapted to be driven by an electric motor (now shown) which is controlled by a switch means including a stationary contact 7 and a movable contact 8 carried by a feeler element 9, an end of which projects into the opening 2 to be driven leftward as shown in FIG. 1 as a pencil is inserted into the opening, thereby establishing an electric conduction between the contacts 7 and 8.

A rotary blade 10 is rotatably supported at its opposite ends by the blade holder 4. In the embodiment shown, the rotary blade 10 includes a cylindrical member 11 formed with spiral cutting edges 12, a pinion 13 and a central shaft 14, wherein the central shaft 14 carries the cylindrical cutting edge member 11 and the pinion 13 in assembly and is received at its opposite ends by bearing openings 15, 16 formed in the blade holder 4. The blade holder 4 is formed with a conical cavity 17, a portion of which including a generatrix is removed to receive a portion of the cylindrical cutting edge member 11 which includes a generatrix of the cylindrical body.

An annular internal gear 18 is fixedly supported by the frame 1, said gear being adapted to mesh with the pinion 13 as the blade holder 4 is rotated by the drive shaft 5, wherein the pinion 13 makes a rotation around its own axis while making a revolution along the teeth of the annular internal gear around the axis of the drive shaft 5.

A cover means 19 is provided as to traverse the blade holder 4 and the rotary blade 10 in a manner such that it isolates the meshing region of the pinion 13 and the annular internal gear 18 from the conical cavity 17. In the embodiment shown, the cover means 19 is formed as a cupshaped member including a cylindrical side wall 19*a* and an oblique end wall 19*b*. The end wall 19*b* is formed with two openings 20 and 21, wherein the opening 20 fixedly receives a reduced yoke portion 7*a* formed at a middle portion of the blade holder 4, whereas the opening 21 rotatably receives a middle portion of the rotary blade which is located between the cylindrical cutting edge member 11 and the pinion 13. The side wall portion 19*a* of the cover means engages over the annular internal gear 18 with a small clearance left therebetween so that when the blade holder 4 rotates around the axis of the drive shaft 5, the cover means 19 supported by the blade holder smoothly rotates around the annular internal gear.

Figure 2A:
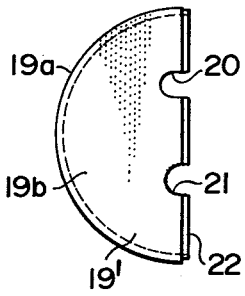
Figure 2B:
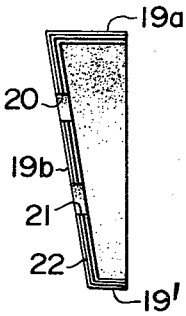
Figure 3A:
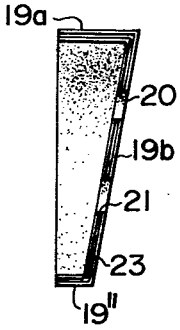
Figure 3B:
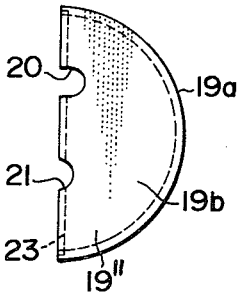

FIGS. 2*a*, 2*b* and 3*a*, 3*b* show an embodiment of the cover means 18 which is made of two halves joined together along a joint which passes the centers of said two openings 20 and 21. FIGS. 2*a* and 3*b* show plan views of the two halves, whereas FIGS. 2*b* and 3*a* show side views of the two halves. In these figures, the portions corresponding to those shown in FIG. 1 are designated by the same reference numerals. As apparent from these figures, the two halves 19' and 19'' are substantially symmetrical except the joint structures formed at the joining portions thereof. At the joint structure, the half 19' is formed with a ridge 22 extending along the joining surface, whereas the half 19'' is formed with a groove 23 similarly formed along the joining surface. These two halves 19', 19'' are closed to each other from opposite sides of the assembly of the blade holder 4 and the rotary blade 10 in a manner such that the yoke portion 17*a* of the blade holder and the bearing portion in the rotary blade formed between the cylindrical cutting blade member 11 and the pinion 13 are bound by the notches formed in the halves 19' and 19'' which define in combination the openings 20 and 21. In the assembly the ridge 22 is engaged into the groove 23 thereby providing a firmly assembled cupshaped cover means 19.

By the provision of the cover means 19 formed and assembled as shown in FIG. 1, the pencil shavings formed by the shaving operation effected by the cutting edges 12 of the rotary blade 10 may fall vertically downward as seen in FIG. 1 because, in this case, the shavings are prevented from entering into the meshing region of the pinion 13 and the annular internal gear 18 by the cover means 19 and will finally fall around the peripheral edge of the inverted cupshaped cover means further downward into a proper shavings receiver (not shown) provided in the lower portion of the frame.

From the foregoing, it will be appreciated that the pencil sharpener according to the present invention is capable to operate in any position without causing the problem of a lock-stopping of the rotary blade due to the biting-in of the pencil shavings in the meshing region of the pinion and the annular internal gear.

Although the invention has been explained with reference to a particular embodiment, it is to be noted that various modifications, additions and/or omissions can be made with respect to the shown embodiment without departing from the spirit of the present invention.

We claim:

1. A pencil sharpener comprising:

a frame;

rotary blade including a cylindrical portion having spiral cutting edges and a pinion co-axially provided at one end of said cylindrical portion;

a blade holder which rotatably supports said rotary blade and defines a conical cavity for receiving an end of a pencil therein;

said blade holder being supported by said frame to be rotatable around the axis of said conical cavity;

an annular internal gear fixedly supported by said frame and meshing with said pinion;

a drive shaft which drives said blade holder around said axis; and a cover means supported by said blade holder to be rotatable therewith;

said cover means traversing said blade holder and said rotary blade thereby isolating the meshing region of said pinion and said annular internal gear from said conical cavity.

2. The pencil sharpener of claim 1, wherein said cover means is a cup-shaped member having cylindrical side wall and oblique end wall, said side wall engaging over said annular internal gear with a small clearance left therebetween, said end wall having first and second openings, said first opening fixedly receiving a portion of said blade holder, whereas said second opening rotatably receives said rotary blade at the portion between said spiral cutting edges and said pinion.

3. The pencil sharpener of claim 2, wherein said cover means is made of two halves which are joined together along a joint which passes the centers of said first and second openings.

4. The pencil sharpener of claim 3, wherein said joint incorporates a ridge and groove formed at different halves of said cover means.

* * * * *